US005921801A

United States Patent [19]

O'Sullivan et al.

[11] Patent Number: 5,921,801

[45] Date of Patent: Jul. 13, 1999

[54] RETENTION SYSTEM FOR ELECTRICAL CONNECTORS

[75] Inventors: Michael O'Sullivan, Willowbrook; Paul Murphy, Naperville; James A. Wetter, Hoffman Estates, all of Ill.

[73] Assignee: Molex Incorporated, Lisle, Ill.

[21] Appl. No.: 08/755,666

[22] Filed: Nov. 25, 1996

[51] Int. Cl.[6] ..... H01R 13/627

[52] U.S. Cl. ..... 439/362

[58] Field of Search ..... 439/362, 364, 439/607, 564, 573

[56] References Cited

U.S. PATENT DOCUMENTS

| | | | |
|---|---|---|---|
| 4,456,319 | 6/1984 | Poulain Ricros | 339/92 R |
| 4,558,916 | 12/1985 | Hehl | 339/107 |
| 5,067,908 | 11/1991 | Guth | 439/248 |
| 5,104,326 | 4/1992 | Smith et al. | 439/95 |
| 5,219,294 | 6/1993 | Marsh et al. | 439/79 |
| 5,267,876 | 12/1993 | Rupert et al. | 439/540 |
| 5,318,463 | 6/1994 | Broschard, III et al. | 439/540 |

*Primary Examiner*—Gary Paumen
*Assistant Examiner*—Katrina Davis
*Attorney, Agent, or Firm*—Charles S Cohen

[57] ABSTRACT

The retention system is provided for a threaded member (14, 54) and an electrical connector (10) which includes a sheet metal shield (46) juxtaposed on a dielectric housing (32). A threaded hole (58) is provided in the shield (46) for 4 threadingly receiving the threaded member (14, 54). A hole (64) is provided in the dielectric housing (32) behind the threaded hole (58) in the shield (46) for threadingly receiving the threaded member (14, 54) after the shank 54 of the threaded member (14, 54) passes through the threaded hole (58) in the shield (46).

During assembly, the threaded members (14, 15) self thread into interfering portions of the housing (32) defined by the housing holes (64) to thereby increase the resistance of threading in order to prevent stripping of the threaded holes (58) in the shield (46).

25 Claims, 4 Drawing Sheets

RETENTION SYSTEM FOR ELECTRICAL CONNECTORS

FIELD OF THE INVENTION

This invention generally relates to the art of electrical connectors and, particularly, to a retention system between a screw member and a shielded electrical connector.

BACKGROUND OF THE INVENTION

Very generally, electrical connectors are devices provided for interconnecting electrical circuits. A typical electrical connector includes a dielectric housing, such as of plastic material or the like, in which are mounted a plurality of terminals terminated to the electrical circuits. The circuits may range from discrete electrical wires to circuit traces on a printed circuit board.

Often, electrical connectors are provided with some form of shielding to protect or shield the electrical terminals or electrical interface from interference, such as electromagnetic or radio interference, whether the interference comes from outside the connector or the interference radiates from within the connector. Such shielding typically is fabricated of stamped and formed, or drawn sheet metal material.

Still further, electrical connectors often have some form of latching or retention system for securing the connector to a complementary mating connector, to a panel, or to a wide variety of other connection devices. Retention systems vary widely and can range from integral latches on the connector to separate threaded or screw members to secure the connector to the mating connector, panel or the like. For instance, one or more "jack screws" are used to directly interconnect a pair of mating connectors. If one of the mating connectors is mounted to a panel, jack screw nuts may be used to mount the connector to the panel, with a mating connector having jack screws for threading into the jack screw nuts. Typically, the jack screw nuts are threaded into internally threaded holes in the sheet metal shield of the connector or into a metal insert within the housing.

A problem with using threaded members or screws, such as the aforementioned jack screws or jack screw nuts, is that the internally threaded holes in the sheet metal shield may have a tendency to become stripped during an assembly operation. For instance, an operator may set a power tool, such as a screw or nut driver, at a particular torque which may vary slightly during repetitive cycles, but the variance is sufficient to cause stripping of the internally threaded holes in the shield. Increased resistance could be achieved simply by increasing the thickness of the sheet metal shield, but this would unnecessarily increase the cost of the connector. The present invention is directed to solving these problems with an improved retention system for threaded members in an electrical connector which includes a sheet metal shield.

SUMMARY OF THE INVENTION

An object, therefore, of the invention is to provide a new and improved electrical connector retention system of the character described.

In the exemplary embodiment of the invention, the retention system is adapted for a threaded member or screw in conjunction with an electrical connector which includes a metal shield juxtaposed on a dielectric housing. A threaded hole is provided in the shield for threadingly receiving the threaded member. A hole is provided in the dielectric housing behind the threaded hole in the shield for threadingly receiving the threaded member after the member passes through the threaded hole in the shield. Therefore, additional resistance is provided against stripping of the threaded hole in the shield without increasing the thickness of the shield.

As disclosed herein, the dielectric housing of the electrical connector is adapted for mounting a plurality of terminals and includes a flange portion defining a face. The sheet metal shield includes a flange portion juxtaposed generally against the face of the flange portion of the housing. The threaded hole is provided in the flange portion of the shield, and the hole in the housing is provided in the flange portion thereof immediately behind the threaded hole in the shield.

Preferably, the connector housing is fabricated of plastic material, and the hole in the plastic housing is orthogonal in cross-section. The hole is tapered from a wider mouth nearer the shield toward a narrower section further from the shield. The hole is also unthreaded.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
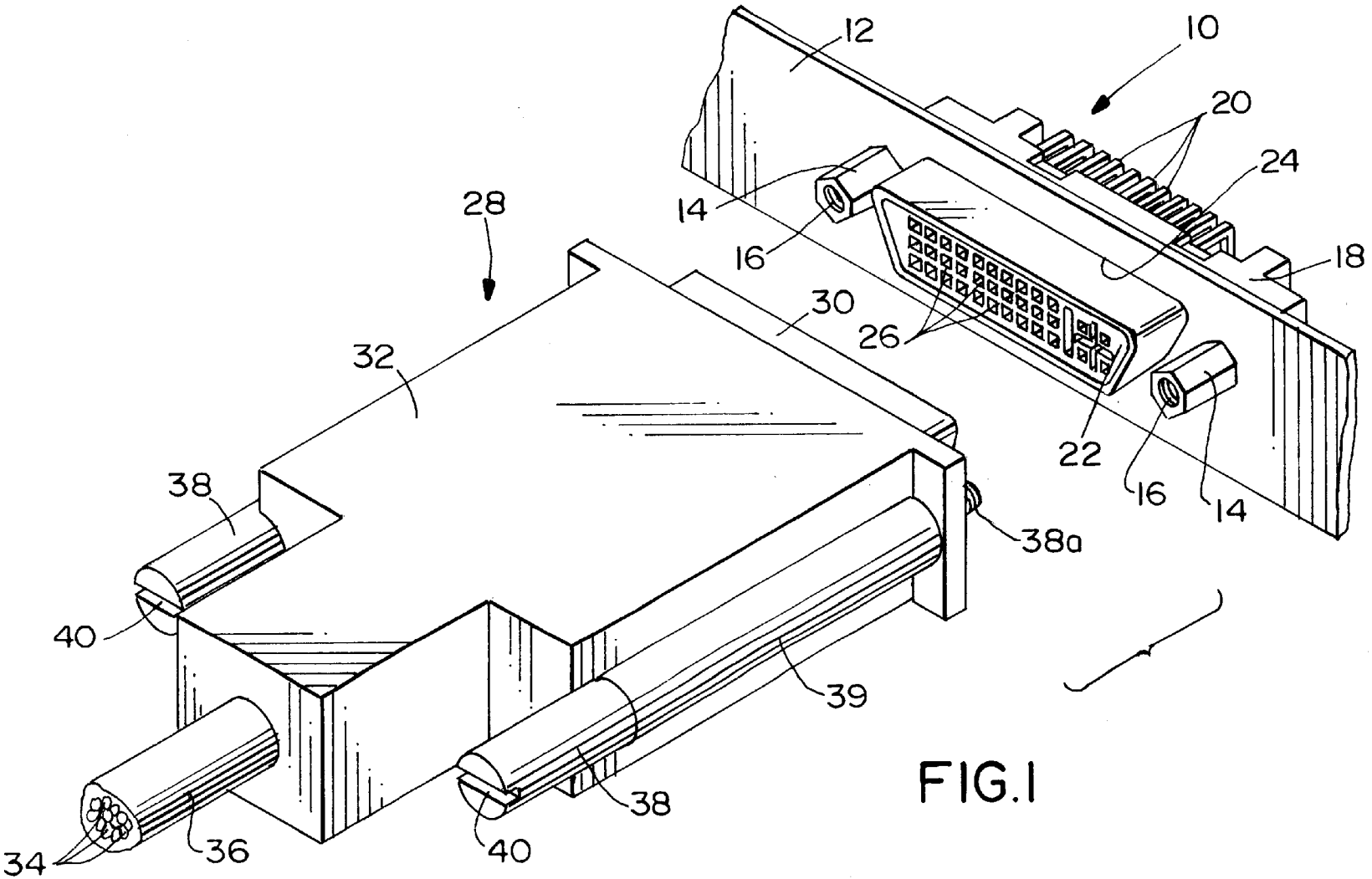
FIG. 1 is an perspective view of a pair of mating connectors just prior to mating, with one of the connectors adapted for use with the retention system of the invention.

Referring to the drawings in greater detail, and first to FIG. 1, a first electrical connector, generally designated 10, is secured to a panel 12 by a pair of jack screw nuts 14. The nuts have internally threaded holes 16. Connector 10 includes a dielectric housing 18, such as of molded plastic material, which mounts a plurality of terminals 20. The housing has a forward mating portion 22 which projects through an aperture 24 in panel 12. The mating portion includes a plurality of passages 26 for receiving terminal pins of a complementary mating connector, generally designated 28. In essence, nuts 14 sandwich panel 12 between the nuts and a front portion of connector 10, as will be seen hereinafter.

Complementary mating connector 28 includes a forward mating portion 30 for mating with portion 22 of connector 10. Connector 28 includes a dielectric housing 32, mounting a plurality of terminals (not shown). Whereas terminals 20 of connector 10 are adapted for connection to circuit traces on a printed circuit board, the terminals within housing 32 of connector 28 are adapted for termination to a plurality of discrete electrical wires 34 of an electrical cable 36. Mating connector 28 has a pair of jack screws 38 freely rotatably mounted in sleeves 39, with threaded distal ends 38a for threading into internally threaded holes 16 of jack screw nuts 14. The opposite ends of jack screws 38 have slots 40 for receiving an appropriate tool, such as a standard flat-blade screw driver, for threading the screws into nuts 14; if necessary.

In the fully assembled, mating condition of connectors 10 and 28, jack screw nuts 14 are effective for securing connector 10 to one side of panel 12, with mating portion 22 projecting through aperture 24 in the panel. Mating portion 30 of complementary connector 28 is mated with portion 22 of connector 10, and the connectors are retained in this mated condition by threading jack screws 38 into nuts 14.

Figure 2:
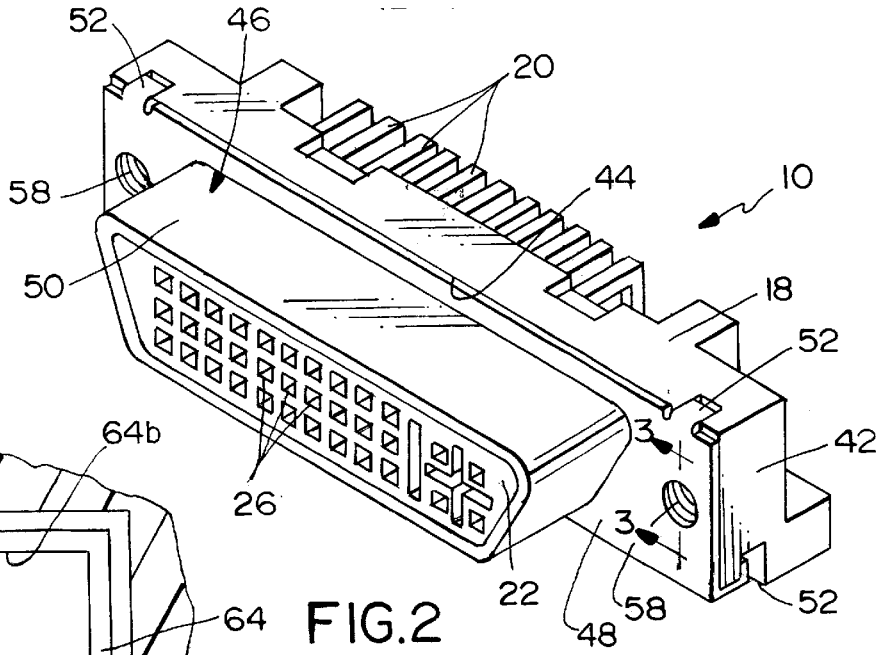
FIG. 2 is a perspective view of the one connector of FIG. 1 incorporating the retention system.

Referring to FIG. 2, dielectric (plastic) housing 18 of electrical connector 10 includes a flange portion 42 defining a front face 44. A sheet metal shield, generally designated 46, includes a flange portion 48 juxtaposed against front face 44 of the dielectric housing. The shield includes a forwardly projecting shroud portion 50 surrounding mating portion 22 of the housing. The shield also has a plurality of mounting tabs 52 for mounting the shield to the housing. When connector 10 is secured to panel 12 by jack screws nuts 14 as shown in FIG. 1, the front face of flange portion 48 of shield 46 abuts the back side of panel 12, as shroud portion 50 of the shield projects through aperture 24 in the panel.

Figure 3:
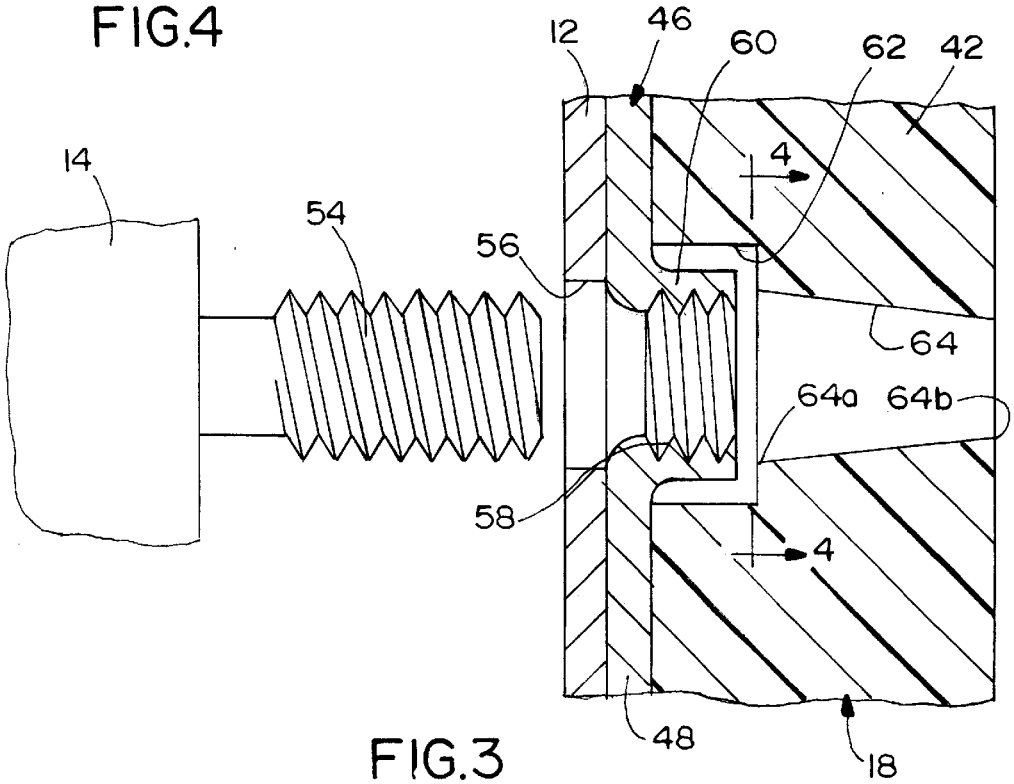
FIG. 3 is an enlarged, fragmented section taken generally along line 3—3 of FIG. 2, in conjunction with a jack screw nut about to be threaded into the connector.

Referring to FIG. 3 in conjunction with FIGS. 1 and 2, each jack screw nut 14 has an externally threaded shank 54. The threaded shank portion is freely insertable through an enlarged hole 56 in panel 12 and is threadingly engageable in an internally threaded hole 58 in flange portion 48 of sheet metal shield 46. Actually, internally threaded hole 58 in the shield is formed in an inwardly projecting boss portion 60 of the sheet metal shield. Dielectric housing 18 is molded with a recess 62 for accommodating boss portion 60.

The retention system of the invention contemplates the provision of a hole 64 in the flange portion 42 of dielectric housing 18 immediately behind internally threaded hole 58 in shield 46, for threadingly receiving shank portion 54 of the jack screw nut after the shank portion passes through threaded hole 58 in the shield. It can be seen that hole 64 in the plastic housing is tapered from a wider mouth 64*a* nearer shield 46 toward a narrower section 64*b* further from the shield and towards the rear of the connector.

Figure 4:
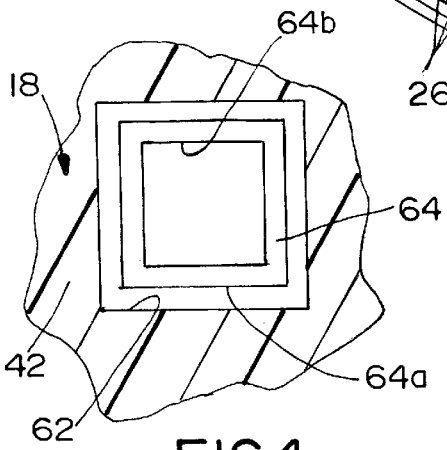
FIG. 4 is a fragmented section taken generally along line 4—4 of FIG. 3.

Referring to FIG. 4 in conjunction with FIG. 3, hole 64 in flange portion 42 of plastic housing 18 is generally square in cross-section. As such, externally threaded shank portion 54 of jack screw nut 14 is not required to be self-tapping, and the orthogonal cross-section of hole 64 provides air gaps at the corners of the orthogonal configuration which facilitate the self-tapping action by providing areas for the threads to begin and also provides a reservoir for the accumulation of material from the tapping action. Still further, hole 64 in the plastic housing preferably is not threaded because the size of the hole is selected to ensure that the torque required for the jack screw to tap into this hole is low enough that the combined torque of threaded through hole 58 in the shield and hole 64 in the housing is not excessive.

Figure 5:
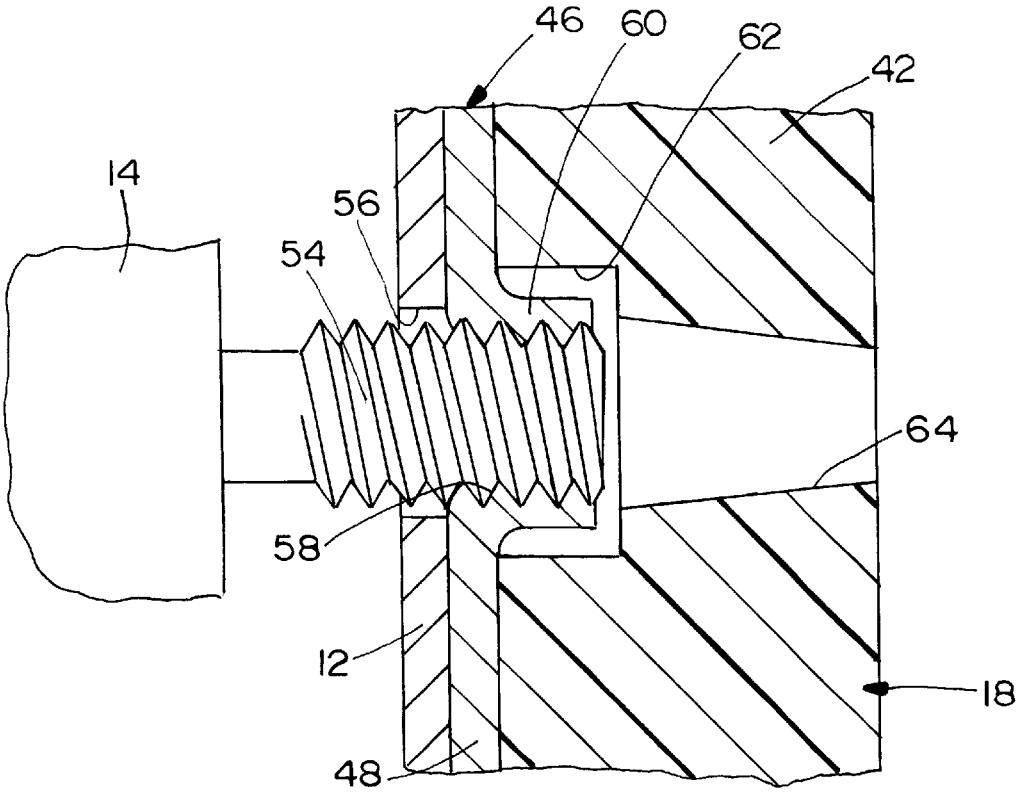
FIG. 5 is a view similar to that of FIG. 3, with the jack screw nut threaded into the internally threaded hole in the shield.

FIG. 5 shows threaded shank 54 of one of the jack screw nuts 14 threaded through hole 58 in boss 60 of sheet metal shield 46. It can be seen that the threaded shank passes freely through hole 56 in panel 12 without any interference.

Figure 6:
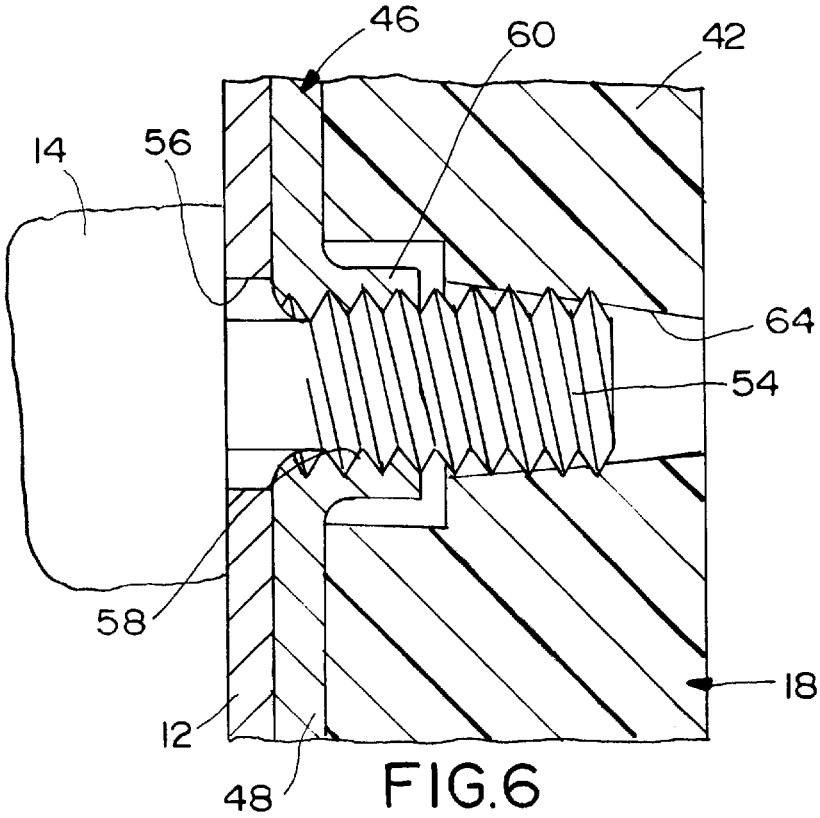
FIG. 6 is a view similar to that of FIGS. 3 and 5, with the jack screw nut fully threaded into both the hole in the shield and the hole in the dielectric housing.

FIG. 6 shows threaded shank 54 of the jack screw nut threaded completely through hole 58 in shield 46 and into unthreaded hole 64 in dielectric housing 18. This represents the condition of connector 10 when completely secured to panel 12 as shown in FIG. 1. During the action of rotating the threaded shank 54 from the position shown if FIG. 5 to that shown in FIG. 6, the threads of shank 54 dig in and actually tap hole 64 to some extent. The strength of the internally threaded hole 58 in the sheet metal shield 46 together with engagement of hole 64 in the plastic housing combine to effectively resist stripping of the threads in hole 58 in the shield.

It should be understood that the invention is not limited to the use of jack screw nuts, such as nuts 14 in the exemplary embodiment of the connector assembly shown herein. In some applications, jack screws 38 or other threaded members may be secured directly into the internally threaded holes in the shield of connector 10 to secure a pair of mating connectors together directly, and to retain the connectors in their mated condition.

Figure 7:
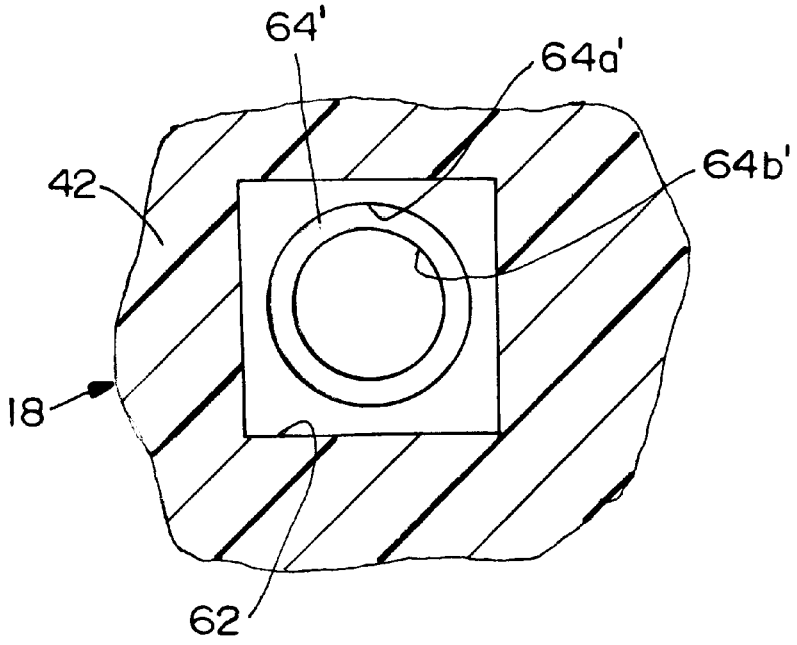
FIG. 7 is a fragmented section view similar to that of FIG. 4 but of an alternate design.
Figure 8:
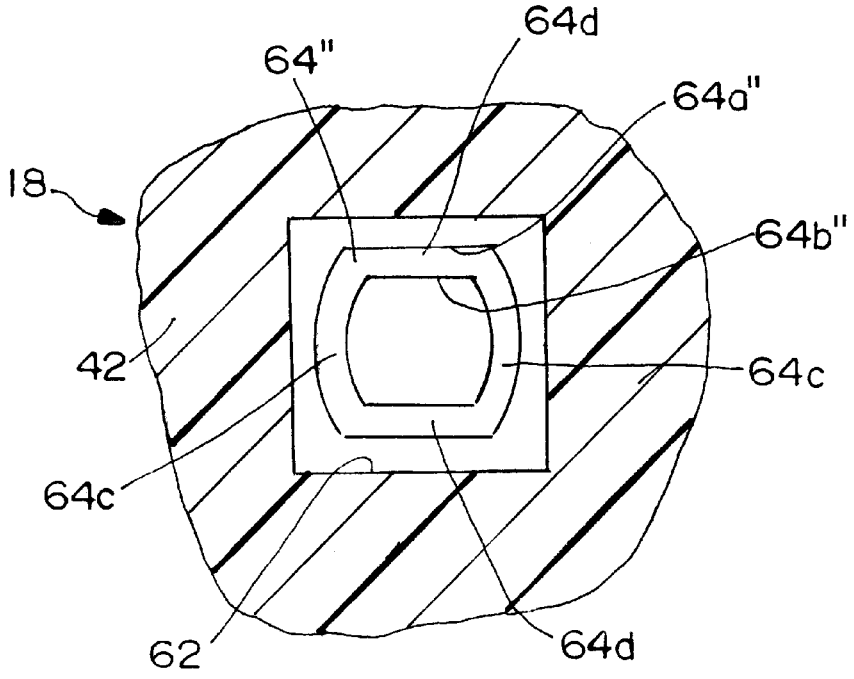
FIG. 8 is a fragmented section view similar to that of FIG. 4 but of still another alternate design.

In addition to the embodiment shown in FIGS. 1–6, FIGS. 7 and 8 show some alternate embodiments. Like reference numbers have been used to indicate like elements. In FIG. 7, the tapered square hole 64 is replaced by a tapered circular hole 64'. Circular hole 64' has a wider circular mouth 64*a*' nearer shield 46 and tapers to a narrower circular mouth 64*b*' further from the shield and towards the rear of the connector. Furthermore, FIG. 8 shows a combination of the structures of FIGS. 1–6 and 7 by utilizing a hole 64" defined by a pair of opposed flat walls 64*c* and a pair of opposed arcuate walls 64*d*. Hybrid hole 64" has a wider hybrid mouth 64*a*" nearer the shield and tapers to a narrower hybrid mouth 64*b*" further from the shield and towards the rear of the connector. In the alternative, other shapes could be utilized such as a hexagon, octagon, etc. Finally, although the holes 64, 64' and 64" are shown as being tapered so that the hole is smaller away from the shield 46, such taper is not believed to be necessary to practice the invention. Although not necessary with the square hole 64 shown in FIGS. 1–6, it may be desirable for shank portion 54 of jack screw nut 14 to be self-tapping for some embodiments of the invention including those shown or described herein.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector retention system, comprising:

a dielectric connector housing adapted for mounting a plurality of terminals and including a flange portion defining a face;

a conductive metal shield mounted on the housing and including a flange portion juxtaposed generally against the face of the flange portion of the housing;

a pair of threaded holes disposed in the flange portion of the shield, each such threaded hole being positioned generally adjacent opposite ends of the shield and configured for threadingly receiving a threaded retention member having a preselected diameter, said threaded holes defining respective retention paths for said threaded retention members; and an interference opening disposed in the flange portion of the housing behind and aligned with each threaded hole in the shield, each of said interference openings defining associated interference portions of said connector housing that respectively extend into said threaded retention member path, such that said threaded retention members will threadedly engage said connector housing interference portions after said threaded retention member pass through said threaded holes, said threaded holes and said connector housing interference portions providing two distinct points of engagement with said threaded retention members.

2. The retention system of claim 1, wherein said interference openings are orthogonal in cross-section.

3. The retention system of claim 2, wherein said interference openings include tapered bores having respective diameters that vary lengthwise of said tapered bores, said tapered bores each having first and second portions disposed at opposite ends thereof, said tapered bore first portions having diameters that approximate said preselected diameters of said threaded holes and said tapered bore second portions having diameters that are less than said tapered bore first portions, said tapered bore second portions thereby extending into said threaded retention member paths for engagement by said threaded retention members.

4. The retention system of claim 1, wherein said interference openings are tapered in longitudinal cross-section and taper from a wide mouth portion disposed nearer said shield toward a narrow portion disposed further from said shield.

5. The retention system of claim 2, wherein said interference openings are unthreaded.

6. The retention system of claim 1, wherein said interference openings are spaced apart from said threaded holes and are unthreaded.

7. The retention system of claim 1 wherein each said threaded hole in the flange portion of the shield is formed in an inwardly projecting boss portion of the shield, and the dielectric connector housing includes a recess for accommodating each inwardly projecting boss portion.

8. An electrical connector comprising:

a dielectric connector housing adapted for mounting a plurality of terminals and including a flange portion defining a face, a pair of unthreaded recesses disposed in said flange portion, one recess being positioned generally adjacent each opposite end of said connector housing, each said recess including a first region generally adjacent said flange and having an enlarged first cross-section and a second region spaced from said flange and having a second cross-section that is smaller than said first cross-section, said recesses having a preselected length that is sufficient to receive therein an end portion of a threaded retention member;

a conductive metal shield mounted on said connector housing and including a flange portion juxtaposed generally against the face of the flange portion of said housing, said shield including a pair of threaded boss portions, each threaded boss portion respectively extending into said first regions of said recesses;

said second region of said recesses being dimensioned so that a threaded retention member completely inserted into one of said threaded boss portions threadingly engages at least a portion of said second region, said second regions providing increased resistance to threading said threaded retention members into said threaded boss portions.

9. The retention system of claim 8, wherein said second regions of said unthreaded recesses have a generally rectangular cross-section.

10. The retention system of claim 9, wherein said second regions of said unthreaded recesses are tapered from a first mouth section disposed near said shield boss portions toward to a second tail section disposed further from said shield boss portions, the first mouth sections being wider than the second tail sections.

11. The retention system of claim 8, wherein said second regions of each of said unthreaded recesses are tapered from a wider mouth nearer said shield toward a narrower section further from said shield.

12. The retention system of claim 8, wherein said second regions of said unthreaded recesses are generally circular in cross-section.

13. A retention system for a threaded member and an electrical connector which includes a metal shield juxtaposed on a dielectric housing, comprising:

a threaded hole disposed in the shield for threadingly receiving the threaded member, the threaded hole defining a path for said threaded member to follow when said threaded member is completely inserted into said threaded hole; and an unthreaded hole disposed in the dielectric housing behind the threaded hole in the shield and spaced apart therefrom for threadingly receiving a lead portion of said threaded member after said threaded member passes through the threaded hole in the shield, said unthreaded hole having a configuration such that at least an associated portion of said dielectric housing extends into said threaded member path and in engaged by said threaded member lead portion when fully inserted into said threaded hole.

14. The retention system of claim 13, wherein said hole in the dielectric housing is tapered from a wider mouth nearer said shield toward a narrower section further from said shield.

15. The retention system of claim 13, wherein said threaded hole in said shield is formed in an inwardly projecting boss portion of said shield, and said dielectric housing includes a recess for accommodating said inwardly projecting boss portion.

16. The retention system of claim 1, wherein said interference openings are generally circular in cross-section.

17. The retention system of claim 16, wherein said interference openings are tapered from a wider mouth nearer said shield toward a narrower section further from said shield.

18. The retention system of claim 1, wherein cross-sections of said interference openings are defined, at least in part, by opposing flat sections and opposing arcuate sections.

19. The retention system of claim 8, wherein said unthreaded recesses in said connector housing are tapered from a wider mouth nearer said shield toward a narrower section further from said shield.

20. The retention system of claim 19, wherein said second regions of said unthreaded recesses in said connector flange portion are tapered from a wider mouth nearer said shield toward a narrower section further from said shield.

21. The retention system of claim 8, wherein cross-sections of said second regions of said recesses in said housing flange portion are defined, at least in part, by opposing flat sections and opposing arcuate sections.

22. The retention system of claim 21, wherein said second regions of said recesses in said housing flange portion are tapered from a wider mouth nearer said shield toward a narrower section further from said shield.

23. The retention system of claim 1, wherein said interference openings are spaced apart from said shield flange portion.

24. The retention system of claim 8, wherein said unthreaded recesses are spaced apart from said threaded boss portions.

25. In a connector component having improved retention capabilities, wherein the connector component includes an elongated connector housing having two opposing ends and opposing, elongated first and second housing faces extending between said two opposing ends, said first housing face including a mating portion disposed thereof for mating to an opposing connector component, a metal plate disposed on at least a portion of said housing first face, the metal plate having two securement openings formed therein on opposite sides of said mating portion, the securement openings being threaded to threadedly receive securement members therein of a preselected length and a preselected diameter for securing said connector component to a portion of an electronic device, said securement openings having a diameter that approximates that of said securement members the improvement comprising:

a pair of interference openings formed in said connector housing and aligned with said securement openings, each of said interference openings having a preselected length, and each said interference opening having a preselected width that varies along its length, such that interference portions of said connector housing surrounding said securement openings extend into the paths of said securement members to interferingly engage said securement members when said securement members are fully inserted into said securement openings, said interference openings being unthreaded to thereby increase resistance of threading said securement members into said securement openings.

* * * * *